US009130264B2

(12) United States Patent
Gervais

(10) Patent No.: US 9,130,264 B2
(45) Date of Patent: Sep. 8, 2015

(54) APPARATUS FOR RAISING AND LOWERING ANTENNAE

(76) Inventor: Jeffrey Gervais, Baytown, TX (US)

( * ) Notice: Subject to any disclaimer, the term of this patent is extended or adjusted under 35 U.S.C. 154(b) by 43 days.

(21) Appl. No.: 13/467,204

(22) Filed: May 9, 2012

(65) Prior Publication Data

US 2013/0300620 A1 Nov. 14, 2013

(51) Int. Cl.
*H01Q 3/02* (2006.01)
*H01Q 1/34* (2006.01)
*H01Q 1/12* (2006.01)

(52) U.S. Cl.
CPC ..... *H01Q 1/1235* (2013.01); *H01Q 3/02* (2013.01); *H01Q 1/34* (2013.01)

(58) Field of Classification Search
CPC ..... H01Q 1/1235
USPC ..... 343/709, 890; 248/274.1, 276.1, 282.1, 248/283.1, 284.1
See application file for complete search history.

(56) References Cited

U.S. PATENT DOCUMENTS

| | | | | |
|---|---|---|---|---|
| 3,382,950 | A | 5/1968 | Sawyer | |
| 3,587,103 | A | 6/1971 | Mills | |
| 3,819,136 | A | 6/1974 | Finke | |
| 4,254,419 | A | 3/1981 | Noddin | |
| 4,384,294 | A | 5/1983 | Crook et al. | |
| 4,399,714 | A | 8/1983 | Barker | |
| 4,433,337 | A | 2/1984 | Smith et al. | |
| 4,545,557 | A | 10/1985 | Rogers | |
| 4,614,900 | A | 9/1986 | Young | |
| 4,621,266 | A | 11/1986 | Le Gall et al. | |
| 4,694,773 | A | 9/1987 | Sparkes et al. | |
| 4,763,592 | A | 8/1988 | Russ | |
| 5,111,212 | A | 5/1992 | DeSatnick et al. | |
| 5,272,486 | A | 12/1993 | Dickinson | |
| 5,410,327 | A | 4/1995 | Shakun et al. | |
| 5,417,178 | A | 5/1995 | Harrelson et al. | |
| 5,485,169 | A | 1/1996 | Kitabatake et al. | |
| 5,517,202 | A | 5/1996 | Patel et al. | |
| 5,517,205 | A | 5/1996 | van Heyningen et al. | |
| 5,670,967 | A | 9/1997 | Sarjala | |
| 5,990,846 | A | 11/1999 | Dichter | |
| 5,999,139 | A | 12/1999 | Benjamin et al. | |
| 6,057,787 | A | 5/2000 | Kell et al. | |
| 6,097,344 | A | 8/2000 | Anderson | |
| 6,476,778 | B1 | 11/2002 | Hussaini et al. | |
| 6,522,301 | B2 | 2/2003 | Takayama et al. | |
| 6,546,677 | B1 * | 4/2003 | Featherstone | 52/118 |
| 7,123,201 | B2 | 10/2006 | Caudle | |
| 7,267,070 | B2 | 9/2007 | Le Page et al. | |
| 7,358,909 | B2 | 4/2008 | Sherwood | |
| 7,366,545 | B2 | 4/2008 | Hurler et al. | |
| 7,570,949 | B1 | 8/2009 | Minerath | |
| 2007/0109205 | A1 | 5/2007 | Nelson | |
| 2008/0156250 | A1 | 7/2008 | Clemmons et al. | |
| 2009/0235870 | A1 | 9/2009 | Troy | |
| 2010/0207828 | A1 | 8/2010 | Overton et al. | |
| 2011/0041834 | A1 * | 2/2011 | Liao | 126/605 |

* cited by examiner

*Primary Examiner* — Robert Karacsony
(74) *Attorney, Agent, or Firm* — Plager Schack LLP

(57) ABSTRACT

This is directed to systems, processes, machines, and other means that raise and lower an antenna. The invention can utilize an actuator to raise and lower an antenna.

6 Claims, 3 Drawing Sheets

APPARATUS FOR RAISING AND LOWERING ANTENNAE

FIELD OF THE INVENTION

This invention relates to marine devices to remotely raise and lower antennae.

BACKGROUND OF THE INVENTION

Prior to the disclosed invention antennae were raised and lowered on marine craft by having a user climb on the side of the vessel to raise and lower the antennae manually. The present invention solves this problem and enables the user to do this remotely.

BRIEF SUMMARY OF THE INVENTION

The present invention includes methods, systems, and other means for raising and lowering antennae. An apparatus for raising and lowering antenna comprises a pivot bar which is immediately adjacent to a T-bracket. The T-bracket is mechanically coupled to a light post and an actuator light post bracket, where the actuator light post bracket is mechanically coupled to an actuator.

BRIEF DESCRIPTION OF THE SEVERAL VIEWS OF THE DRAWINGS

Figure 1:
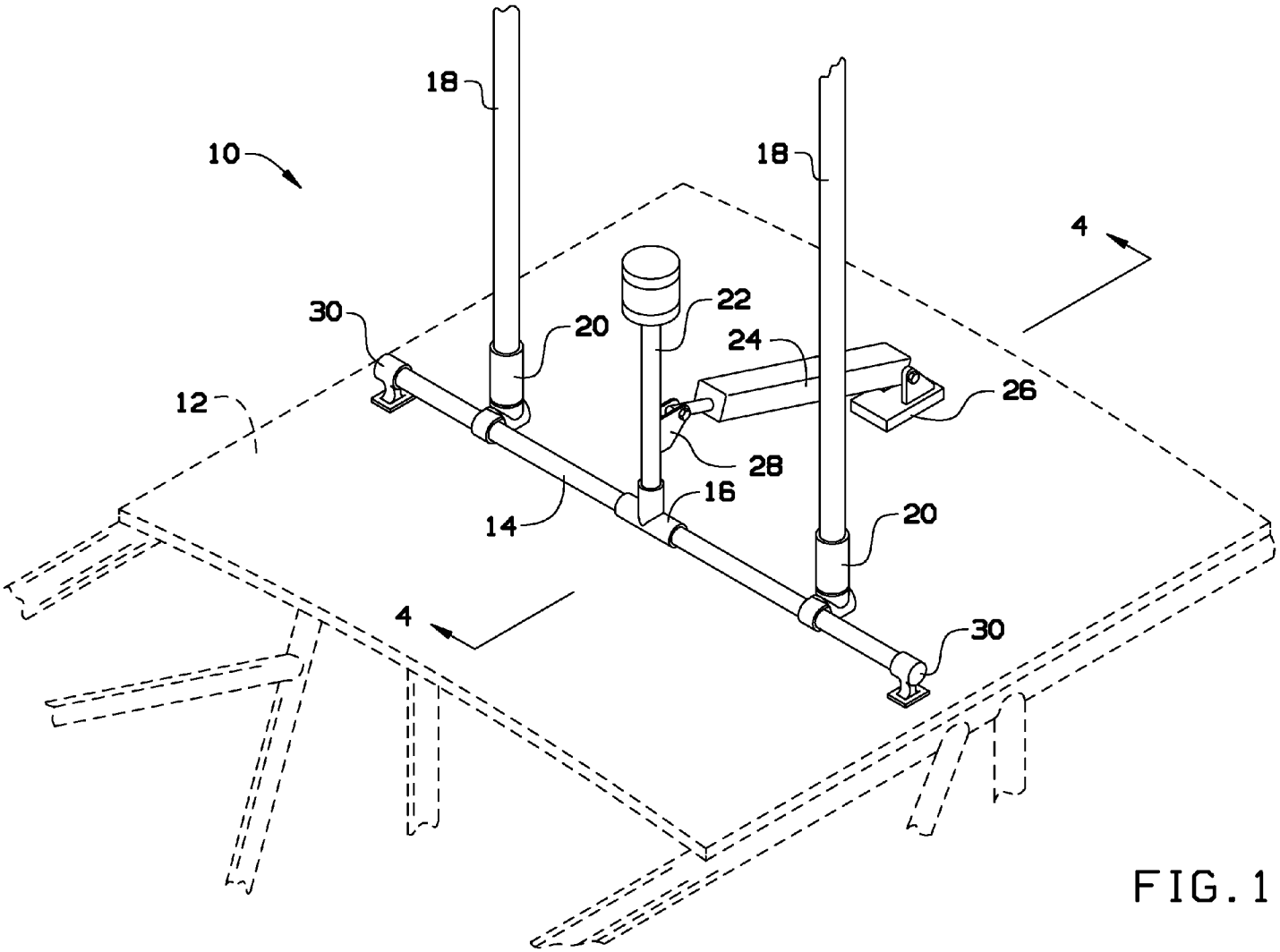

Having thus described the invention in general terms, reference will now be made to the accompanying drawings, which are not necessarily drawn to scale, and wherein:

FIG. 1 is a perspective view of the invention illustrated in use and in deployed/raised configuration.

Figure 2:
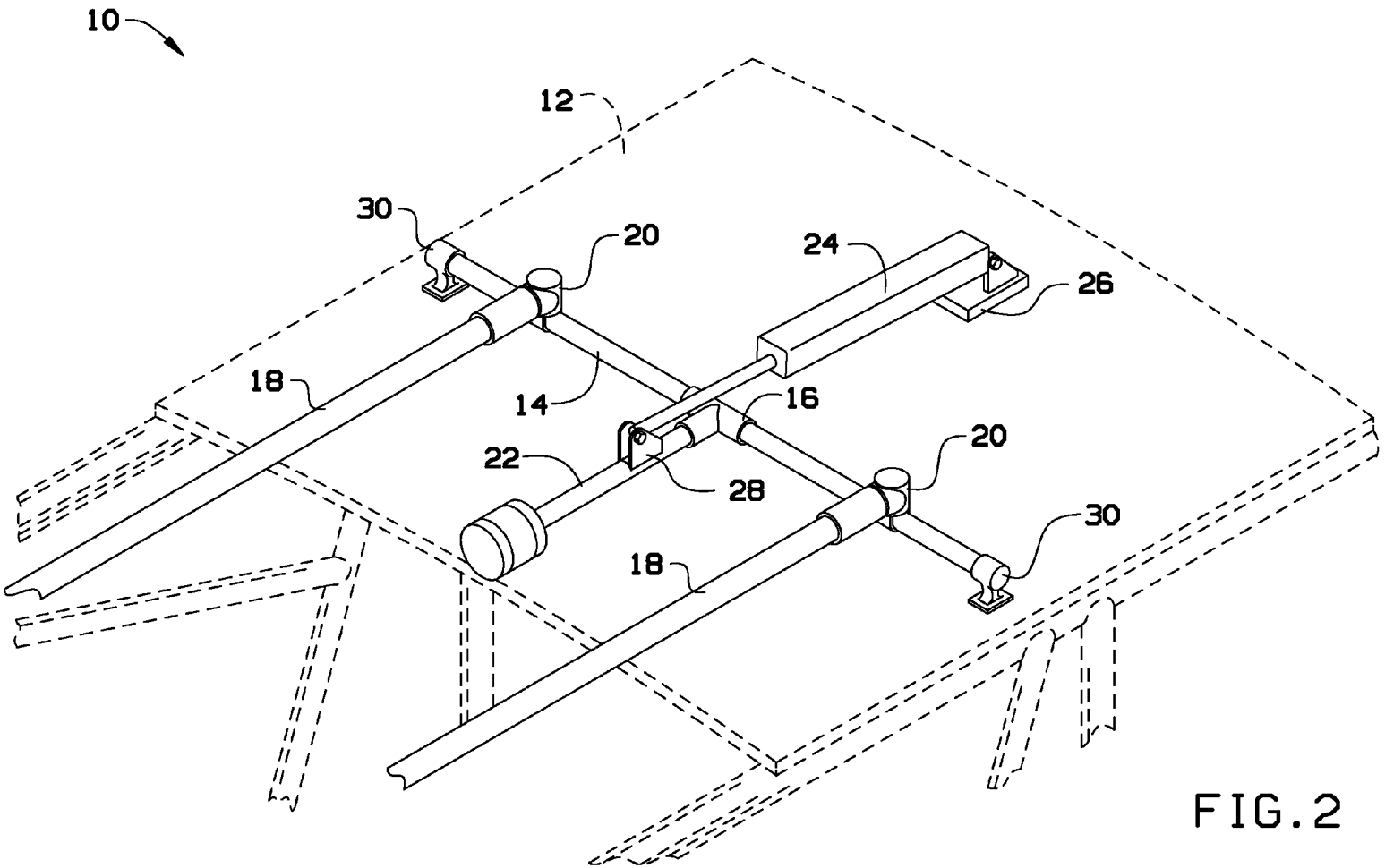

FIG. 2 is a perspective view of the invention illustrated in use and in retraced/lowed configuration.

Figure 3:
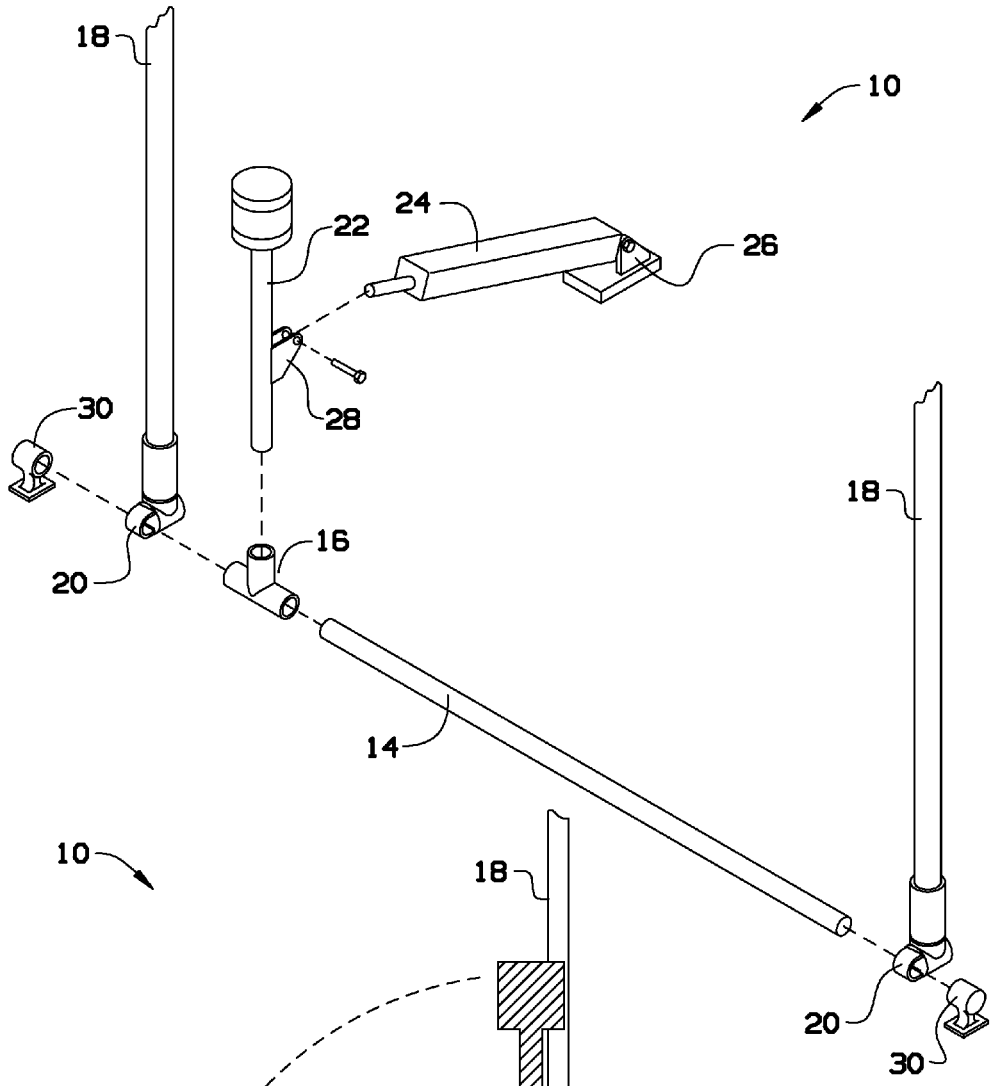

FIG. 3 is an exploded view of the invention.

Figure 4:
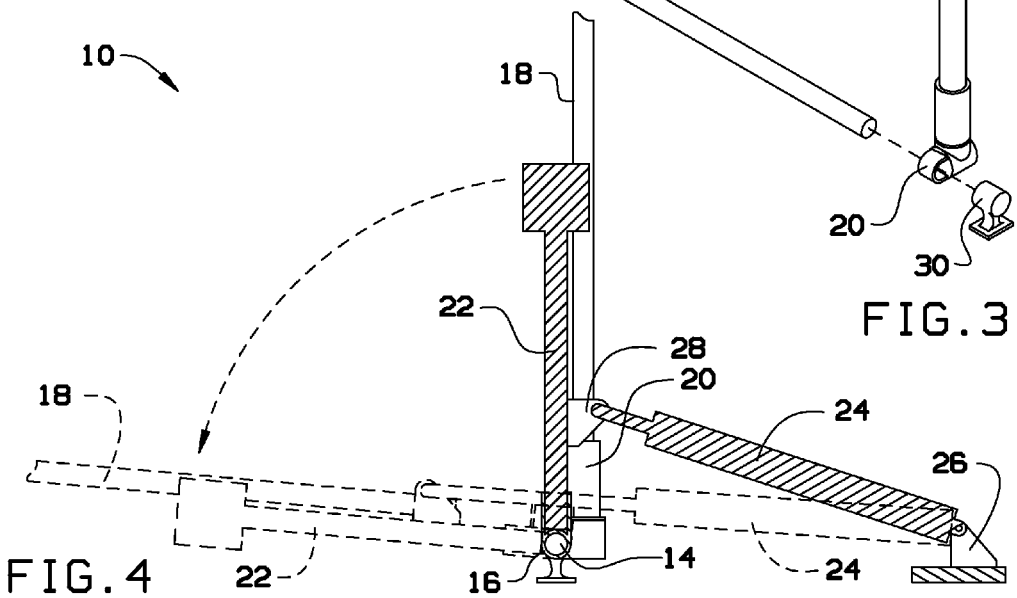

FIG. 4 is a section view of the invention along line 4-4 in FIG. 1.

DETAILED DESCRIPTION OF THE INVENTION

Embodiments of the present invention overcome many of the obstacles associated with raising and lowering antennae, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. Antennae assembly 10 is designed to be mechanically coupled to mounting platform 12. Antennae assembly 10 comprises pivot bar bracket 30 is mechanically coupled to pivot bar 14. Pivot bar 14 is immediately adjacent to antenna bracket 20 and T-bracket 16. Antenna bracket 20 is mechanically coupled to antenna 18. T-bracket 16 is mechanically coupled to light post 22 and actuator light post bracket 28. Actuator light post bracket 28 is mechanically coupled to actuator 24, which is further mechanically coupled to actuator platform bracket 26. Actuator platform bracket 26 is mechanically coupled to mounting platform 12.

FIG. 2 shows antennae assembly 10 in use. Actuator 24 is electrically coupled to a 12 V source. The 12 V source is electrically coupled to a switch. The switch can be activated from a remote location either by electrically coupled system or a remote-controlled system. The switches activated actuator 24 expands pushing away light post bracket 28 and folding down light post 22 and antenna 18 as shown.

FIG. 3 shows an exploded view of antennae assembly 10. Symbol the device a user inserts pivot bar 14 through T-bracket 16 and antenna bracket 20 into pivot bar bracket 30. In some embodiments pivot bar 14 can be mechanically coupled to T-bracket 16 and antenna bracket 20 by welding, bolting or with any other known coupling technique. As shown here, actuator 24 is mechanically coupled to actuator light post bracket 28 by a bolt.

FIG. 4 is a section view of antennae assembly 10. As noted above, this invention enables the user to lay down antennae from a remote location. As actuator 24 expands, actuator 24 pushes light post 22 toward mounting platform 12 (not shown). This allows a user to easily set down antennae 18 without having to climb up the side of a boat.

The invention claimed is:

1. An apparatus for raising and lowering an antenna comprising:

a pivot bar which is immediately adjacent to a T-bracket;

the T-bracket is mechanically coupled to a light post and an actuator light post bracket;

the actuator light post bracket is mechanically coupled to actuator;

a pivot bar bracket is mechanically coupled to the pivot bar;

wherein the pivot bar is immediately adjacent to an antenna bracket;

the antenna bracket is mechanically coupled to an antenna; and the actuator is further mechanically coupled to an actuator platform bracket.

2. The apparatus for raising and lowering an antenna of claim 1 further comprising, the actuator is electrically coupled to a switch;

wherein a user can use the switch to activate the actuator.

3. The apparatus for raising and lowering an antenna of claim 1 further comprising, the actuator is electrically coupled to a switch;

wherein a user can use the switch to activate the actuator;

wherein the switch is activated by a remote control.

4. An apparatus for raising and lowering an antenna comprising, a pivot bar, immediately adjacent to a T-bracket;

a light post, mechanically coupled to the T-bracket;

an actuator light post bracket, mechanically coupled to the T-bracket;

an actuator, mechanically coupled to the actuator light post bracket;

a pivot bar bracket, mechanically coupled to the pivot bar;

an antenna bracket, immediately adjacent to the pivot bar; and an antenna, mechanically coupled to the antenna bracket.

5. The apparatus for raising and lowering an antenna of claim 4 further comprising, the actuator is electrically coupled to a switch;

wherein a user can use the switch to activate the actuator.

6. The apparatus for raising and lowering an antenna of claim 4 further comprising, the actuator is electrically coupled to a switch;

wherein a user can use the switch to activate the actuator;

wherein the switch is activated by a remote control.

* * * * *